US005542407A

United States Patent [19]

Hawkinson

[11] Patent Number: 5,542,407

[45] Date of Patent: Aug. 6, 1996

[54] FIREPLACE ASSEMBLY

[75] Inventor: Eric Hawkinson, Mt. Pleasant, Iowa

[73] Assignee: Hon Industries Inc., Muscatine, Iowa

[21] Appl. No.: 268,796

[22] Filed: Jul. 1, 1994

[51] Int. Cl.[6] ..... F24C 3/00

[52] U.S. Cl. ..... 126/77; 126/515; 126/193; 126/512

[58] Field of Search ..... 126/512, 518, 126/516, 503, 193, 77, 200, 198, 500, 515, 517

[56] References Cited

U.S. PATENT DOCUMENTS 4,332,235 6/1982 Hannebaum ..... 126/515
4,494,525 1/1985 Albertsen ..... 126/77 X
4,793,322 12/1988 Shimek et al. ..... 126/193 X

FOREIGN PATENT DOCUMENTS 8801723 2/1990 Netherlands ..... 126/77
2172989 10/1986 United Kingdom ..... 126/77

*Primary Examiner*—Carl D. Price
*Attorney, Agent, or Firm*—Jones, Day, Reavis & Pogue

[57] ABSTRACT

A fireplace assembly of the type used as a room air heater comprises a second pane of glass in front of and spaced from the glass pane forming the front of the combustion chamber. The two panes form an air passageway for delivering intake air from an upper vent to the bottom of the combustion chamber. The intake air cools the panes of glass such that a relatively inexpensive glass material can be used and such that the front of the fireplace assembly is relatively cool to the touch.

3 Claims, 3 Drawing Sheets

60
86
90
94
88
66
96
84
64
68
82
62
72
76
74
100
102
80
78
70
98

FIREPLACE ASSEMBLY

BACKGROUND OF THE INVENTION

1. Field of the Invention

The present invention relates to fireplace assemblies and, more particularly to fireplace assemblies of the direct vent type.

2. Description of the Prior Art

Fireplace assemblies have long been available as prefabricated units. One form of fireplace unit functions as a room heater and comprises a combustion chamber surrounded by an enclosure providing a passageway for circulating room air over the combustion chamber. Heated air may thereby be circulated into the room by use of an electric blower mounted in the passageway. This type of fireplace is preferably fired with natural or LP gas and has ceramic artificial logs simulating the appearance of a wood burning fireplace while offering the advantage of efficiently converting the natural or LP gas to room heat.

A fireplace assembly of the foregoing type typically has a combustion chamber with a forwardly facing glass pane permitting the fire to be viewed by the occupant of the room. Although the glass pane furthers the aesthetically pleasing simulation of a real log fire, the pane becomes hot and can present a personal injury hazard to the room occupant. Also, to withstand high temperatures, the pane must be made from a relatively expensive glass. In addition, because of the heat of the combustion chamber, the gas valve must be located in a separate cooler compartment, typically beneath the combustion chamber. This has the disadvantages of making it difficult to remove the burner assembly when desired. It would therefore be desirable to provide a fireplace assembly which has a cooler glass front for the combustion chamber. It would further be desirable to provide a more compact unit than is currently available without sacrificing heating efficiency and output. Still further it would be desirable to provide a fireplace assembly having a modular, unitized burner and valve system which can be readily removed and replaced when desired.

SUMMARY OF THE INVENTION

The present invention provides a fireplace assembly having two frontal panes of glass spaced from one another to define an air passageway. The air passageway is in communication between an upper air supply vent and the bottom of the combustion chamber. As a fire is burning in the combustion chamber ambient air is drawn through the supply vent and down through the passageway, thereby cooling the panes of glass. The inner pane of glass, which essentially forms the frontal wall of the combustion chamber is cooled sufficiently such that it can be manufactured from a less expensive material than now used. The outer pane of glass is cool enough to be touched without risk of injury. Because the cool air which is drawn through the passageway supplies the bottom of the combustion chamber, a modular unitized burner and valve assembly may be mounted directly within the combustion chamber for easy removal and replacement.

BRIEF DESCRIPTION OF THE DRAWINGS

The features and advantages of the invention will become apparent from the following detailed description taken in connection with the accompanying drawings wherein.

DETAILED DESCRIPTION OF THE PREFERRED EMBODIMENTS

Figure 1:
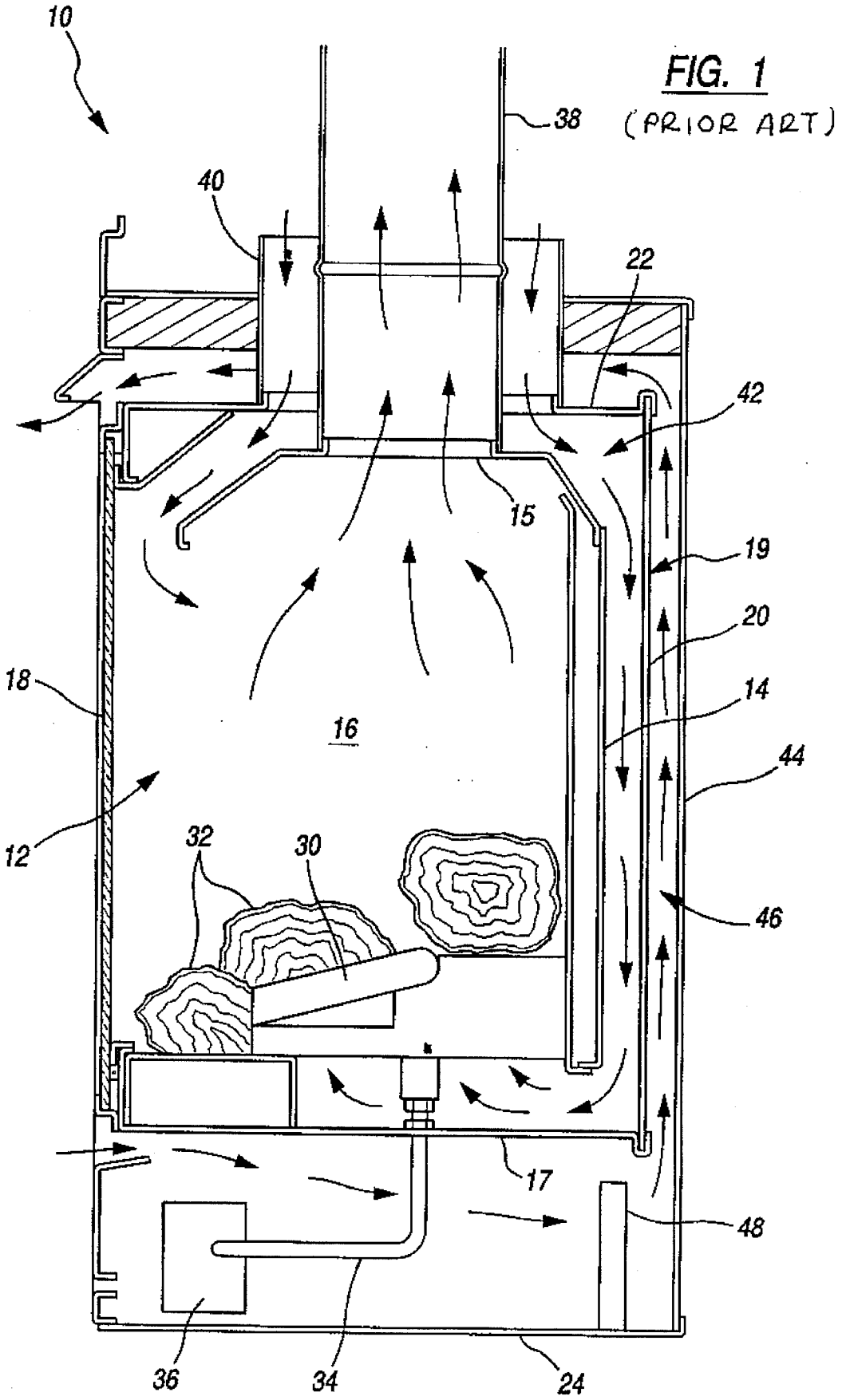
FIG. 1 (PRIOR ART)
FIG. 1 is a side schematic view of a fireplace assembly constructed according to the prior art.

Referring now to the drawings, and initially to FIG. 1, a typical prior art fireplace assembly, designated generally by the reference numeral 10, includes a combustion chamber 12 defined by a rear wall 14, a top wall 15, a pair of side walls 16 (only one of which can be seen), a bottom wall 17 and a frontal pane of glass 18. The combustion chamber 12 is enclosed by a shell 19 comprising a rear wall 20, a top wall 22, bottom wall 24 and side walls.

Positioned within the combustion chamber 12 is a gas burner assembly 30 and a plurality of artificial ceramic gas logs 32, constructed in a manner well-known in the art as to simulate the appearance of a natural wood burning fireplace. The burner 30 is supplied from its underside by a conduit 34 connected to a conventional valve assembly 36.

Combustion byproducts are exhausted from the combustion chamber 12 by an upper exhaust vent 38 disposed in direct communication with the combustion chamber 12. An ambient air supply vent 40 is disposed concentrically around the exhaust vent 38 to supply ambient air to the combustion chamber 12. The ambient air is drawn by gravity from the supply vent 40 through a passageway 42 defined by the rear wall 14 of the combustion chamber 12 and the rear wall 20 of the shell 19. The passageway 42 leads to the underside of the combustion chamber 12.

In order to provide for circulation of heated air into the room, the fireplace assembly 10 includes an outer wall 44 spaced from and enclosing the shell 19 defining a passageway 46. The passageway 46 may be provided with a suitable blower 48 for drawing room air into the bottom of the assembly 10 and circulating it over the shell 19 whereupon it is heated and discharged at the top of the assembly 10.

Figure 2:
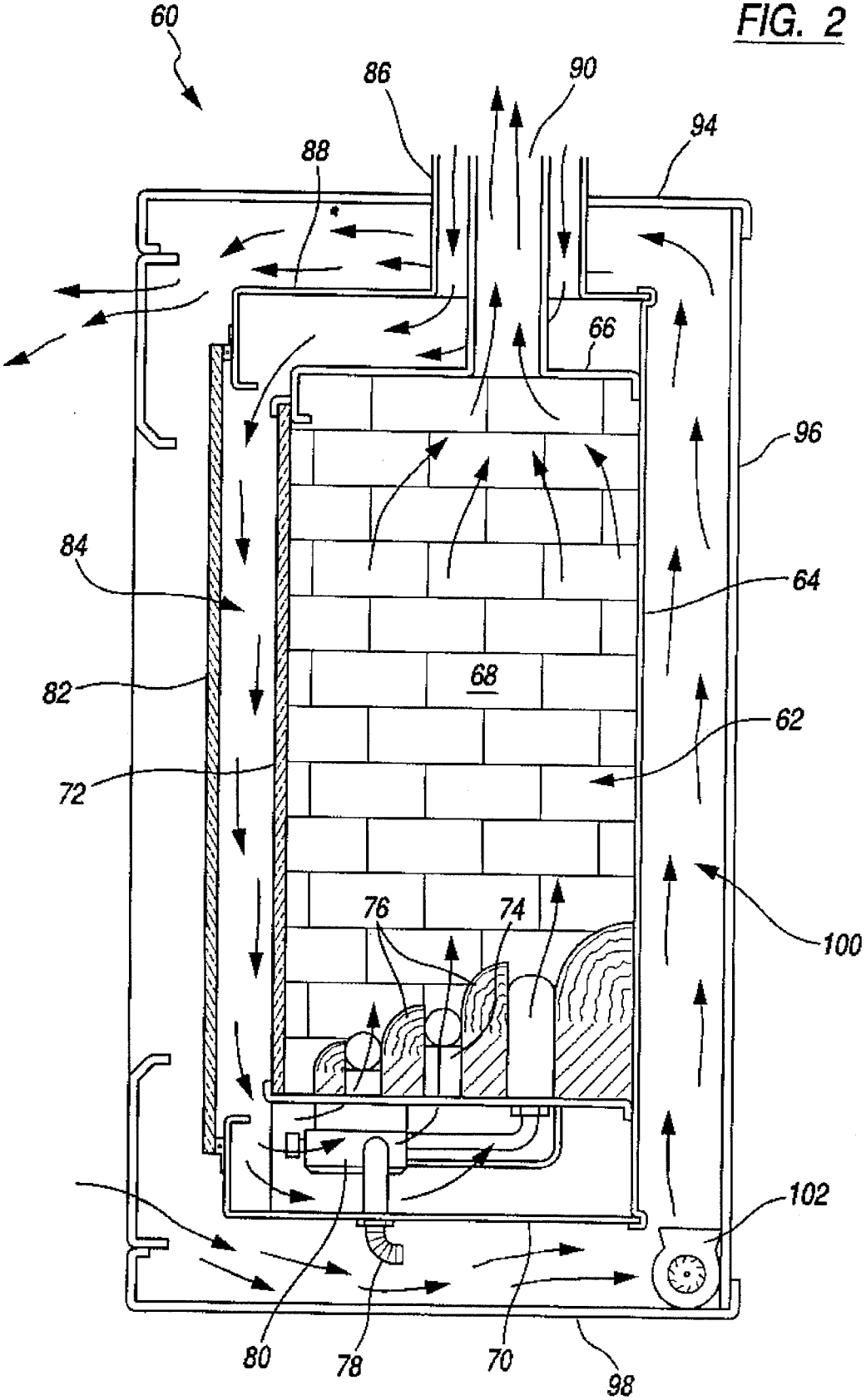
FIG. 2 is a side schematic view of a fireplace assembly constructed in accordance with the invention.

Turning now to FIG. 2, there is illustrated a fireplace assembly 60 constructed in accordance with the invention including a combustion chamber 62 defined by a rear wall 64, a top wall 66, a pair of side walls 68, a bottom wall 70 and a frontal pane of glass 72. Positioned within the combustion chamber 62 is a burner assembly 74 and a plurality of artificial ceramic gas logs 76. The burner is supplied from its underside with natural gas by a conduit 78 and valve assembly 80.

In accordance with the invention, the fireplace assembly 60 is provided with a second pane of glass 82 spaced from the pane 72 and defining an air passageway 84 therebetween. The passageway 84 communicates with an air inlet vent 86 by means of an upper shroud 88. In operation, combustion byproducts are exhausted from the combustion chamber 62 through an upper exhaust vent 90. Ambient air is simultaneously drawn into the underside of the combustion chamber 62 through passageway 84. The combustion chamber 62 is enclosed within a shell 92 having a top wall 94, a rear wall 96 and a bottom wall 98 which, together with the walls 64, 66, 68 and 70, of the combustion chamber 62, define an air passageway 100. Room air is circulated through the passageway 100 by a blower 102 causing the air to be heated primarily by the rear wall 64 of the combustion chamber 62.

Experiments have determined that in a thirty-six inch wide fireplace, an optimum spacing of the glass panes 72 and 82 is approximately one inch. If the air passageway 84 is too wide, such as two inches for example, the inlet air will move too slowly through the passageway 84 to adequately cool the glass panes 72 and 82. If the air passageway 84 is too narrow, such as one-half inch in a thirty-six inch wide unit, there is insufficient inlet air drawn through the passageway 84 to adequately supply the burner assembly 74.

Figure 3:
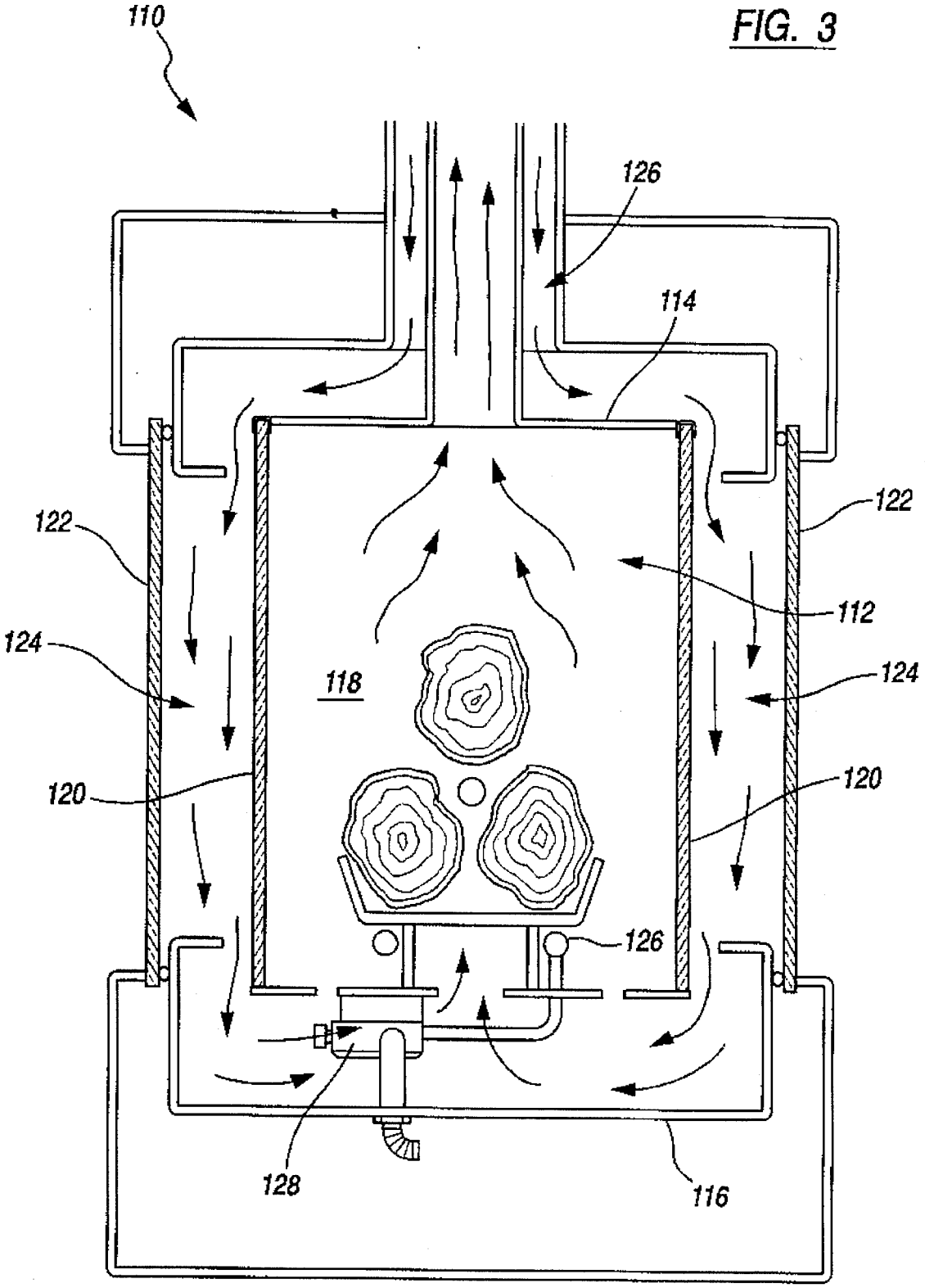
FIG. 3 is a side schematic view of a second embodiment of a fireplace assembly constructed in accordance with the invention.

In a second embodiment of the invention, as illustrated in FIG. 3, a fireplace assembly 110 includes a combustion chamber 112 defined by an upper wall 114, a lower wall 116, a pair of side walls 118 (only one of which can be seen) and a pair of glass panes 120. Spaced from each pane 120 is a second glass pane 122 defining air passageways 124 therebetween. In communication with the air passageway 124 is an air inlet vent 126. As in the embodiment of FIG. 2, inlet air is drawn through the vent 126 and passageways 124 to the bottom of the combustion chamber 112 where it supplies combustion air for a suitable natural gas or LP burner assembly 126. A gas regulator 128 for the burner 126 may be installed underneath the burner assembly 126 directly within the flow of inlet air.

It can now be appreciated that the fireplace assembly 60 of the instant invention improves over the prior art in the provision of double glass panes 72 and 82 which provide an inlet air passageway 84 for the combustion chamber 62 while at the same time allowing the fire to be viewed by the room occupant. The air drawn over the panes 72 and 82 cools the panes 72 and 82 such that the exposed outer surface of pane 82 is not excessively hot. By this arrangement panes 72 and 82 can be manufactured from a less expensive glass than is possible in the prior art assembly 10. Moreover, there is a reduced risk of harm, by burning, to the occupant of the room.

By employing passageway 84 as the exclusive path for intake air to the combustion chamber 62, dual passageways 42 and 46 of the prior art fireplace 10 can be replaced by the single passageway 100 of the assembly 60, whereby the assembly 60 can be fabricated in more compact form and better heat transfer can be obtained between the combustion chamber 62 and the circulated room air. The result is a more energy efficient unit. Also, unlike in the prior art assembly 10, the valve assembly 80 can be mounted within the combustion chamber 62 because it can be positioned within the path of the relatively cool intake air. This allows the burner 74 and log set 76 to be more easily removed for retrofitting by simple disconnection of gas supply conduit 104.

The invention 110 of FIG. 3 wherein double glass panes 120 and 122 and provide multiple walls of the combustion chamber 112 permits a fireplace assembly to be constructed in which the fire can be viewed from any angle. For example, where it is desired to have an island fireplace, sidewalls 118 may also be configured with dual panes of glass allowing the fire to be viewed from any position within the room. Also, three sides of the fireplace may be configured with dual panes of glass for a fireplace mounted against a wall but projecting into the room. As in the embodiment of FIG. 2, the fireplace 110 of FIG. 3 is fabricated such that the gas valve 128 is a modular or unitized member in association with the burner assembly 126 whereupon the burner assembly 126 and valve 128 can be readily replaced when needed.

While the present invention has been described in connection with particular embodiments thereof, it will be understood that many changes may be made without departing from the true spirit and scope of the invention.

What is claimed is:

1. A fireplace assembly comprising:

a combustion chamber having a forwardly facing optically transparent wall;

a second optically transparent wall spaced from said combustion chamber wall defining an air passageway;

an intake air vent disposed above said combustion chamber in communication with said air passageway; and an exhaust air vent disposed internal to said intake air vent and being in communication with said combustion chamber;

said air passageway being in communication with a bottom of said combustion chamber;

wherein intake air is drawn downwardly from said intake air vent through said passageway thereby exchanging heat from said optically transparent walls to said intake air and said intake air flows into the bottom of said combustion chamber combining with fuel in said combustion chamber to form combustion byproducts which are exhausted from said combustion chamber through said exhaust air vent.

2. The fireplace assembly of claim 1 including a combustion valve assembly positioned within said combustion chamber.

3. The fireplace assembly of claim 1 further comprising an enclosure defining a second air passageway at least partially around said combustion chamber for exchanging heat from said combustion chamber.

* * * * *